US009004310B2

(12) United States Patent
Schütz

(10) Patent No.: US 9,004,310 B2
(45) Date of Patent: Apr. 14, 2015

(54) TRANSPORTING AND STORING CONTAINER FOR LIQUIDS

(71) Applicant: Protechna S.A., Fribourg (CH)

(72) Inventor: Udo Schütz, Selters (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 13/687,870

(22) Filed: Nov. 28, 2012

(65) Prior Publication Data

US 2013/0146607 A1 Jun. 13, 2013

(30) Foreign Application Priority Data

Dec. 7, 2011 (DE) ..... 10 2011 087 927

(51) Int. Cl.
*B65D 8/08* (2006.01)
*B65D 25/20* (2006.01)
*B65D 77/04* (2006.01)

(52) U.S. Cl.
CPC ..... *B65D 25/20* (2013.01); *B65D 77/0466* (2013.01)

(58) Field of Classification Search
USPC ..... 220/650, 648, 612, 668, 1.5, 23.87, 220/495.01; 206/386
See application file for complete search history.

(56) References Cited

U.S. PATENT DOCUMENTS

| | | | | |
|---|---|---|---|---|
| 4,909,387 | A * | 3/1990 | Schutz | 206/386 |
| 5,645,185 | A * | 7/1997 | Cassina | 220/1.5 |
| 7,036,662 | B2 * | 5/2006 | Schutz | 206/386 |
| 2004/0164082 | A1 | 8/2004 | Schutz | |

FOREIGN PATENT DOCUMENTS

| | | | |
|---|---|---|---|
| DE | 3839647 | A1 | 5/1990 |
| DE | 29719830 | U1 | 5/1998 |
| DE | 10301517 | B3 | 3/2004 |
| DE | 102006037944 | A1 | 3/2007 |
| DE | 60215991 | T2 | 6/2007 |
| EP | 1439130 | A1 | 7/2004 |
| KR | 1019960034018 | | 10/1996 |

OTHER PUBLICATIONS

Korean Intellectual Property Office, Office Action, Application No. 10-2012-0136439, Jan. 13, 2014.
Canadian Intellectual Property Office, Examination Report, Application No. 2,797,314, Jul. 31, 2013.
(Continued)

*Primary Examiner* — Anthony Stashick
*Assistant Examiner* — James Way
(74) *Attorney, Agent, or Firm* — Quarles & Brady LLP

(57) ABSTRACT

A transport and storing container for liquids includes a pallet-type base frame for an inner container made of plastic with side walls, a lower wall and an upper wall. A closable filler neck is formed on the upper wall. A draining neck with a tapping armature is formed on a lower section of a side wall. A cage mantle with horizontal and vertical bars made of metal receives the inner container, wherein the vertical bars comprise between a connection section and a linear longitudinal section with a tubular cross section a bent section, and at least the upper ends of the vertical bars comprise a convex cross section outline on their inner side facing the inner container in the transition of the connection section to the bent section.

10 Claims, 5 Drawing Sheets

(56) References Cited

OTHER PUBLICATIONS

European Patent Office, Search Report, EP 12195586, May 23, 2013.

State Intellectual Property Office of People's Republic of China, First Office Action and Search Report, Application No. 201210526561.6, Jul. 24, 2014, 14 pages.

* cited by examiner

Fig. 6
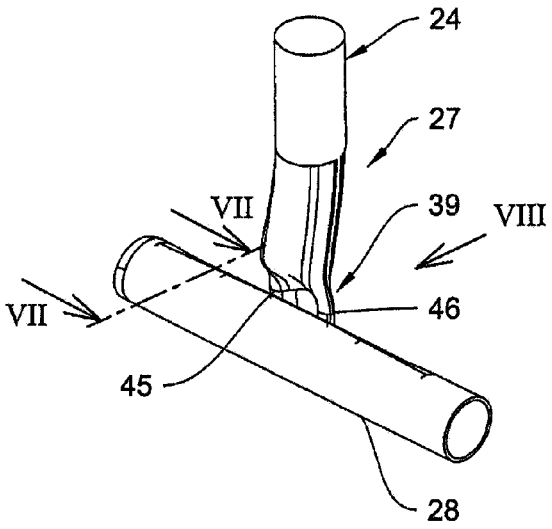
Fig. 7
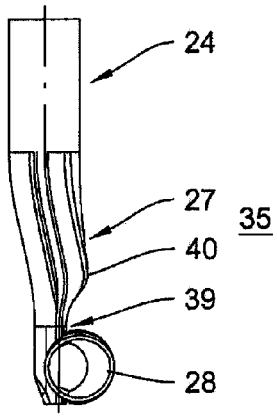
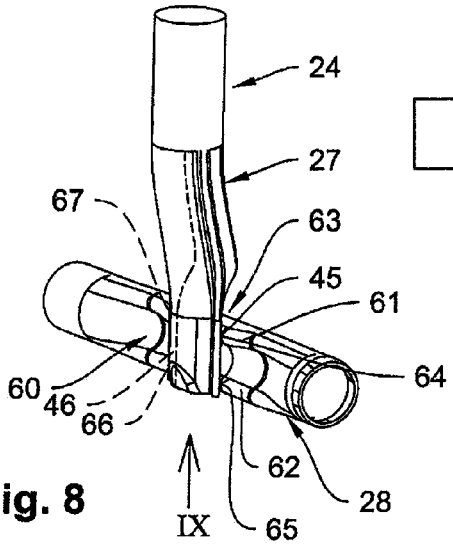
Fig. 8
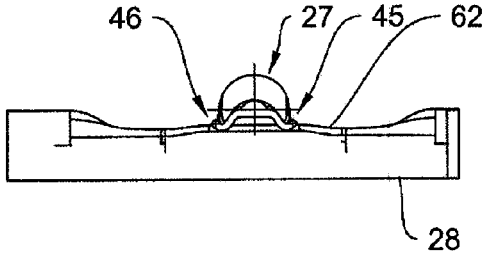
Fig. 9

Fig. 10
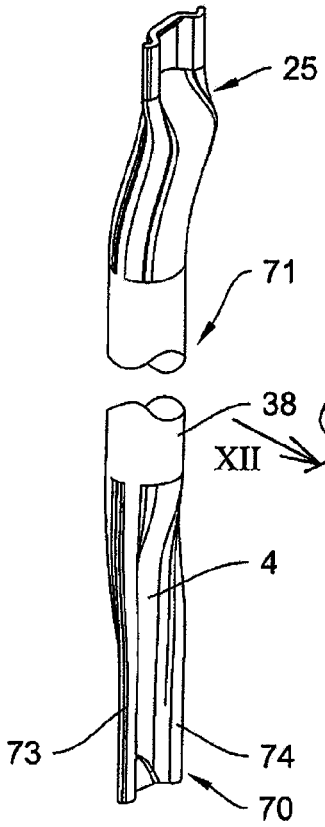
Fig. 11
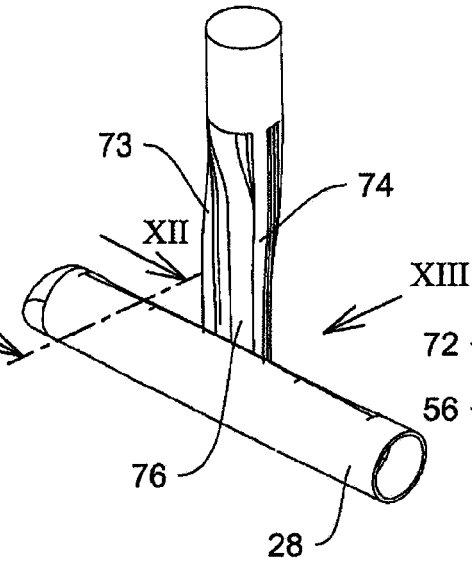
Fig. 12
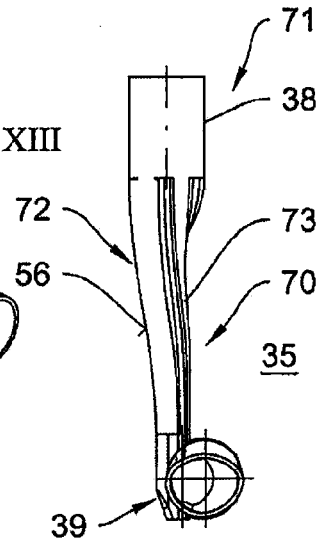
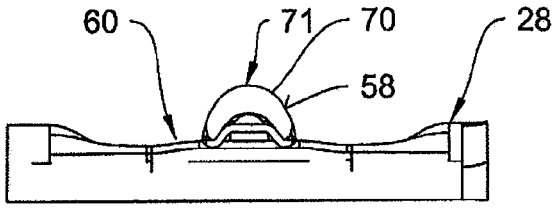
Fig. 14
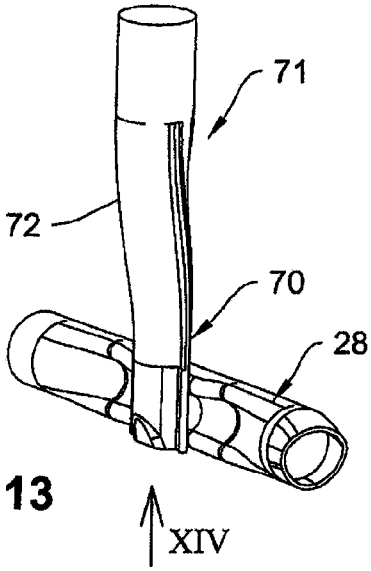
Fig. 13

TRANSPORTING AND STORING CONTAINER FOR LIQUIDS

CROSS REFERENCE TO RELATED APPLICATION

The present application claims the benefit of German Patent Application No. 10 2011 087 927.7 filed Dec. 7, 2011, which is fully incorporated herein by reference.

STATEMENT REGARDING FEDERALLY SPONSORED RESEARCH OR DEVELOPMENT

Not applicable.

FIELD OF THE INVENTION

The present invention relates to a transport and storing container for liquids with a pallet-type base frame for an inner container made of plastic with four side walls, a lower and an upper bottom wall, a closable filler neck formed on the upper bottom wall, a draining neck with a tapping armature formed on a lower section of a side wall, and a cage mantle with horizontal and vertical bars made of metal for receiving the inner container, wherein the ends of the vertical bars formed as hollow profiles are welded to a lower and an upper circumferential edge profile of the cage mantle, wherein at least the upper edge profile comprises a ridge running crosswise to the vertical bars for forming connection sites for a welded joint with the upper ends of the vertical bars, and wherein at least the upper ends of the vertical bars comprise a connection section with a reduced cross-section formed by reshaping for the welded joint with the upper edge profile, wherein the vertical bars comprise a bent section between the connection section and a linear longitudinal section with a tubular cross-section.

BACKGROUND OF THE INVENTION

Transport and storing containers of the kind mentioned in the beginning are, for space-saving storage, often set up in a stacked arrangement, in which at least two transport and storing containers are arranged one on top of the other, in such a way that the upper container is disposed with the corner and middle legs of the pallet-type base frame on top of the upper edge profile of the lower container. As a result of this stacked arrangement, a correspondingly high load is put in particular on the connection sites of the cage mantle that are formed by welded joints. During dynamic use, such as the transport of the containers set up in a stacked arrangement, said load can reach significant peaks of stress.

From EP 1 439 130 A1, a transport and storing container for liquids is known in which the vertical bars of the cage mantle comprise a bent section in the transition to a flattened connection section which is formed on an upper end of the bar so that in the area of the bent section the vertical bar has a certain elasticity, which makes a decrease and reduction of peak loads possible and thus relieves the welded joint accordingly.

The bent-shaped design of the vertical bars in the transition to the flattened connection sections leads to a bending load on the vertical bars in this area so that the vertical bars in the area of the bent section do exhibit an elasticity relieving the welded joint, but are subject to a higher bending load in the transition to the connection section than linear-formed vertical bars. In order to be adequately secured against component failure in spite of this additional bending load, the vertical bars with the bending section have an according wall thickness.

SUMMARY OF THE INVENTION

The object of the present invention is to provide a transport and storing container whose cage mantle comprises vertical bars with a bent section formed in the transition to the connection section, wherein the transport and storing container has the necessary security against component failure and can still be manufactured with a minimum of material cost.

This object is met by a transport and storing container including a base frame supporting a plastic inner container The inner container has side walls, a lower wall and an upper wall. A closable filler neck is formed on the upper wall. A draining neck with a tapping armature is formed on a lower section of at least one of said side walls. A cage mantle with horizontal and vertical bars made of metal receives the inner container Lower ends of the vertical bars form a hollow profile and are welded to a lower circumferential edge profile of the cage mantle and upper ends of the vertical bars form a hollow profile and are welded to an upper circumferential edge profile of the cage mantle. At least the upper circumferential edge profile includes a ridge running crosswise to the vertical bars forming connection sites for a welded joint with the upper ends of the vertical bars. At least the upper ends of the vertical bars include a connection section with a cross section reduced by reshaping for the welded joint with the upper edge profile. The vertical bars include a bent section between the connection section and a linear longitudinal section with a tubular cross section. At least the upper ends of the vertical bars include a convex cross-section outline in a transition of the connection section to the bent section on an inner side facing the inner container.

According to the invention, the vertical bars are formed in such a way that at least their upper ends comprise in the transition from the connection section to the bent section a convex cross-section outline on their inner side facing the inner container. Due to the special cross-section outline in the area of the transition susceptible to buckling, a higher security against buckling is made possible even if a tube material with a relatively reduced wall thickness is used.

As a result, the general possibility arises to guarantee the desired high standard against container failure for the transport and storing container even if a tube material with a relatively thin wall thickness is chosen for producing the vertical bars. Thus it can be made secure even for a tube material with a relatively thin wall thickness that a breaking of a vertical bar due to exceeding the critical buckling load can be eliminated with sufficient likelihood. Said breaking of a vertical bar, i.e. component failure of a vertical bar, could otherwise lead to a broken end of the vertical bar penetrating the plastic inner container, which would directly result in container failure.

In addition to the weight advantage provided by using a tube material with a relatively thin wall thickness, the possible reduction of production costs for a transport and storing container due to the corresponding saving of material has of course to be noted as a further substantial advantage resulting from the realization according to the invention, It is particularly advantageous if the upper ends as well as the lower ends of the vertical bars have a convex cross-section outline in the transition from the connection section to the bent section so that the lower ends provide a higher security against component failure as well.

Preferably, the convex cross-section outline extends from the connection section across the bent section into the longitudinal section and the bent section comprises a recess at least in a transition section to the connection section so that in the transition section a sufficient rigidity is achieved while the cross-section is reduced.

It is particularly advantageous if the recess is formed in the shape a groove and extends from the connection section to the longitudinal section.

Due to the cross-sectional form resulting from the groove-shaped recess and compared to a vertical bar whose bent section is not equipped with a groove-shaped recess in the transition to the connection section, a rigid structure is made possible, providing a higher buckling safety, notwithstanding the desired elastic flexibility in the transition to the connection section. Herein, the effect of the groove-shaped recess can be roughly compared to the stiffening effect of a bead while having the particularity that said groove-shaped recess extends from the connection section across the bent section to the longitudinal section. Compared to vertical bars whose bent section is not equipped with such a groove-shaped recess, this structural reinforcement of the vertical bars provides even further improved buckling safety when using tube material with relatively thin wall thickness.

In a particularly advantageous embodiment, the bent section is realized in such a way that due to the recess in the cross-section of the bent section edge ridges are formed, which extend up into the connection section. Hereby, the edge ridges, which are formed by the recess, can in their extension into the connection section be used simultaneously for forming crossing sites with the ridge of the upper edge profile of the cage mantle.

If, due to the recess, a kidney-shaped cross-section is formed which continuously extends with a convex wall section of the bar opposing the groove-shaped recess from the longitudinal section across the bent section into the connection section of the bar, a further increase in buckling safety in the area of the bent section and in the transition from the bent section to the connection section is achieved.

In a particularly preferred embodiment, the convex wall section together with the edge ridges of the recession in the connection sections form a bowl-shaped connection trough with a further edge ridge connecting the edge ridges so that the connection section is formed correspondingly torsion-resistant.

If the upper ends of the vertical bars comprise humps formed on the edge ridges in the transition from the connection section to the bent section, an increase in stiffness can be achieved directly in the area that is particularly susceptible to buckling.

If the edge ridges on the lower ends of the vertical bars exhibit a substantially linear extension in the transition from the connection section to the bent section, the lower ends are formed particularly elastically flexible compared to the upper ends, in particular in the case of a vibrating strain occurring vertical to the longitudinal extension of the bars.

It is particularly advantageous for a welded joint between the lower edge profile of the cage mantle and the lower ends of the vertical bars if the lower edge profile comprises connection areas with a through-shaped recess which form edge ridges that form crossing sites with the edge ridges of the connection section of the lower ends of the vertical bars.

BRIEF DESCRIPTION OF THE DRAWINGS

In the following, a preferred embodiment the invention is illustrated in detail with the help of drawings. Showing:

FIG. 6 an illustration of the of the connection of the lower end of the vertical bar to the lower edge profile of the cage mantle illustrated in FIG. 1;

FIG. 7 a view of the bar connection illustrated in FIG. 6 according to section VII-VII in FIG. 6;

FIG. 8 an illustration of the bar connection according to view VIII in FIG. 6;

FIG. 9 a lower view of the bar connection illustrated in FIG. 8 according to view IX in FIG. 8;

FIG. 10 a further embodiment of a lower end of a vertical bar in an isometric illustration;

FIG. 11 an illustration of the connection of the lower end of the vertical bar illustrated in FIG. 10 to the lower edge profile of the cage mantle illustrated in FIG. 1;

FIG. 12 a view of the bar connection illustrated in FIG. 11 according to section XII-XII in FIG. 11;

FIG. 13 a lower view of the bar connection according to view XIII in FIG. 11;

FIG. 14 a lower view of the bar connection illustrated in FIG. 13 according to view XIV in FIG. 13.

DETAILED DESCRIPTION OF THE EXAMPLE EMBODIMENTS

Figure 1:
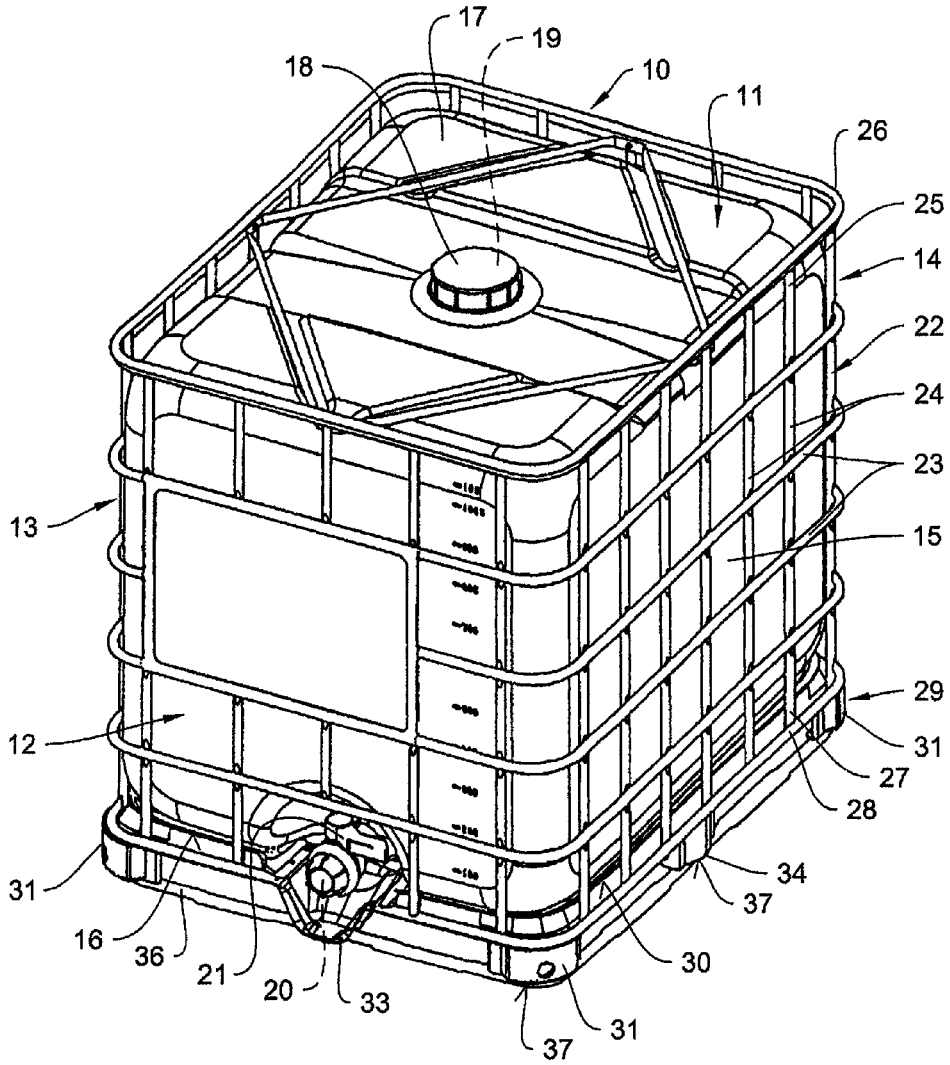
FIG. 1 a perspective illustration of a transport and storing container with a cage mantle which comprises an upper and a lower edge profile, which are connected by vertical bars.

FIG. 1 shows a transport and storage container 10 for liquids, usable as a disposable or reusable container, which comprises an inner container 11 made of plastic with four side walls 12, 13, 14 and 15 and a lower and an upper bottom wall 16, 17, a filler neck 19, closable with a lid 18 and formed on the upper bottom wall 17, and a draining neck 20 with a tapping armature 21 formed on a lower section of the side wall 12, further an outer cage mantle 22 of horizontal and vertical metal bars 23, 24 crossing each other for receiving the inner container 11. The vertical bars 24 are welded with an upper end 25 to an upper edge profile 26 and with a lower end 27 to a lower edge profile 28 of the cage mantle 22. Furthermore, the cage mantle 22 is connected via its lower edge profile 28 to a pallet-type base frame 29.

The pallet-type base frame 29 comprises a bottom wall 30, on which the inner container 11 is disposed, and which is arranged on corner legs 31, a not further illustrated back side middle leg, a front side middle leg 33 formed from the bottom wall 30, and two lateral middle legs 33, 34. The corner legs 31 and the middle legs 33, 34 are in the present case arranged on a base frame 36 of the pallet-type base frame 29 in such a way that they protrude outwards over the base frame 36 with stacking extensions 37, which are arranged and formed in such a way that a number of transport and storing containers 10 can be set up on top of each other in a not further illustrated stacking arrangement, wherein the stacking extensions 37 of the corner legs 31 and the middle legs 33, 34 of the upper transport and storing container 10 sit on the upper edge profile 26 of the cage mantle 22 of the lower transport and storing container.

Figure 2:
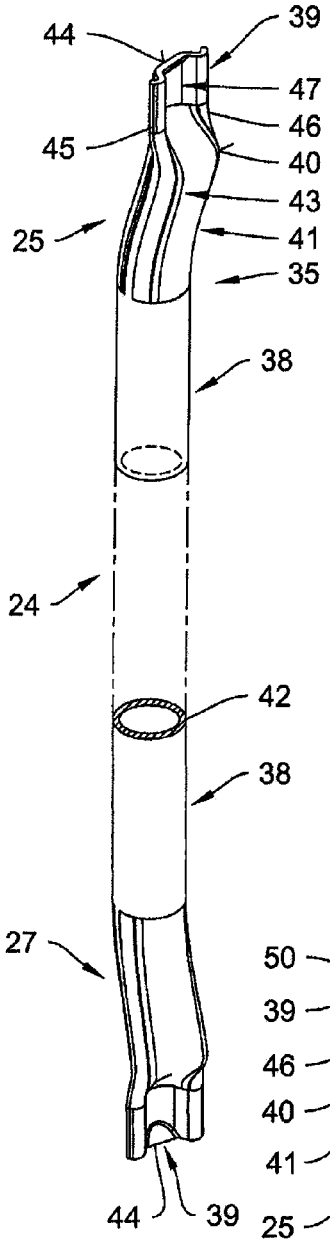
FIG. 2 a vertical bar in a single illustration.

FIG. 2 shows a vertical bar 24 with substantially correspondingly formed upper and lower ends 25, 27, which are connected via a longitudinal section 38 formed substantially linear, which for merely illustrational reasons is illustrated interrupted in the drawing. The upper end 25 as well as the lower end 27 comprise for a connection with the upper edge profile 26 and the lower edge profile 28 of the cage mantle 22 a flattened connection section 39, which is connected via a bent section 41 to the linear longitudinal section 38, which comprises a tubular cross-section 42. On its outer side 35 facing away from the inner container 11, the bent section 41 is equipped with a groove-shaped recess 43, which extends from the connection section 39 across the bent section 41 into the longitudinal section 38.

On the free end of the connection section 39, the groove-shaped recess 43 is defined by an axial edge ridge 44, which forms a bowl-shaped connection trough 47 in the connection section 39 together with mutually parallel edge ridges 45, 46, which extend in a longitudinal direction of the bent section 41 and are formed by the groove-shaped recess 43. Towards the longitudinal section 38 of the vertical bar 24, the groove-shaped recess 43 passes slightly ascending into the tubular cross-section 42 of the longitudinal section 38.

Figure 3:
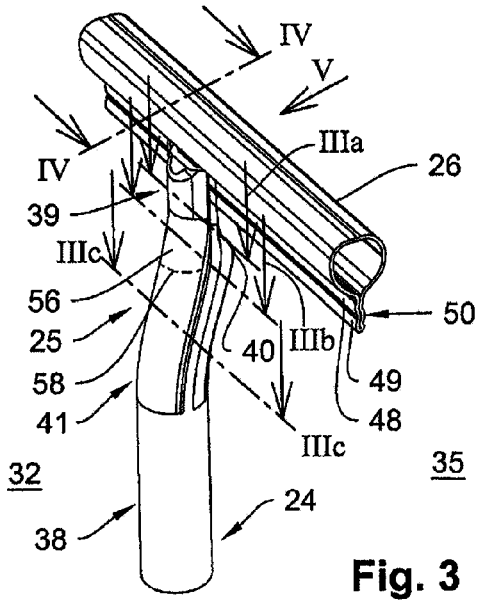
FIG. 3 the connection of a vertical bar to the upper edge profile.
Figure 4:
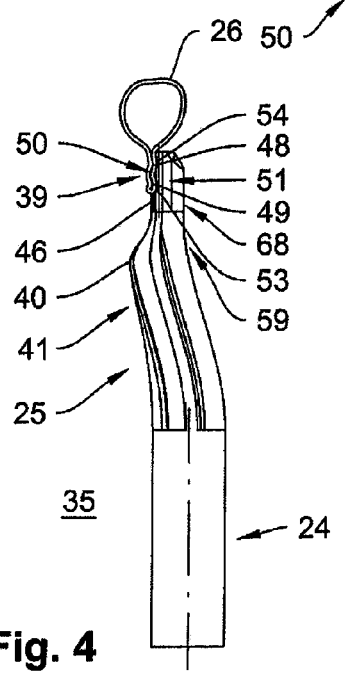
FIG. 4 the bar connection illustrated in FIG. 3 in a sectional illustration according to section IV-IV in FIG. 3.
Figure 5:
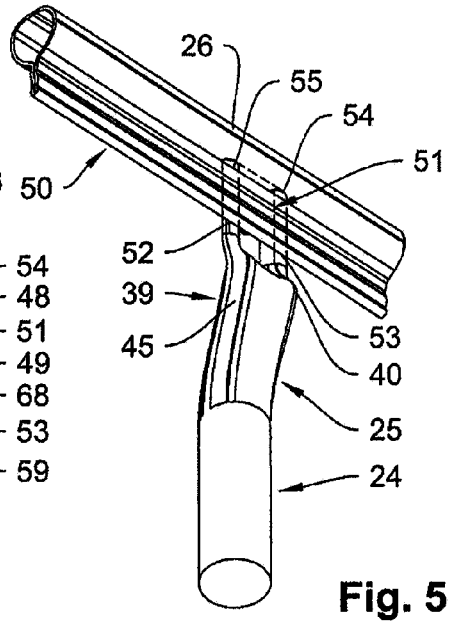
FIG. 5 a view of the bar connection illustrated in FIG. 3 according to view V in FIG. 3.

As it becomes clear from a combination of FIGS. 3, 4 and 5, which show the connection of the vertical bar 24 with its upper end 25 to the upper edge profile 26 of the cage mantle 22, in an area of the connection section 39, the edge ridges 45, 46 form a crossing site 51 with a double ridge 50 of the upper edge ridge 26 comprising two parallel edge ridges 48, 49, said crossing site 51 having four points of contact 52 to 55, on which via welded contacts a firmly bonded connection between the upper edge profile 26 and the upper end 25 of the vertical bar 24 is established. As it is further made clear by FIGS. 3, 4 and 5, in the transition from the connection section 39 to the bent section 41, the edge ridges 45, 46 comprise humps 40 oriented towards an outer side 35 of the cage mantle 22 (FIG. 1), which stiffen the cross-sectional transition from the connection section 39 to the bent section 41.

Figure 3C:
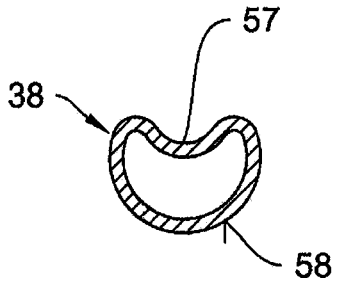
FIG. 3*c* a cross-sectional illustration of the upper bar end according to section IIIc-IIIc in FIG. 3.
Figure 3B:
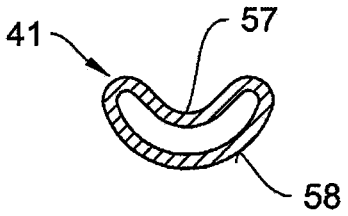
FIG. 3*b* a cross-sectional illustration of the upper bar end according to section in FIG. 3.
Figure 3A:
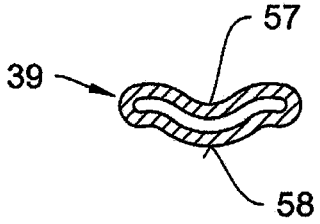
FIG. 3*a* a cross-sectional illustration of the upper bar end according to section IIIa-IIIa in FIG. 3.

As it is particularly shown by FIG. 3, a wall section 56 opposite of the groove-shaped recess 43 comprises a convex cross-section outline 58 on an inner side 32 of the bent section 41 facing the inner container 11 (FIG. 1) so that the upper end 25 of the vertical bar 24 has from the connection section 39 across the bent section 41 to the longitudinal section 38 an about kidney-shaped cross-section, which, as illustrated in FIGS. 3*a*, 3*b* and 3*c*, does have a different lumen and a different size in the respective sections (connection section 39, bent section 41 and longitudinal section 38), but comprises in all sections opposite to a depression 57 formed by the groove-shaped recess 43 a convex cross-section outline 58, which extends from the connection section 39 across the bent section 41 to the longitudinal section 38.

As it is shown it FIGS. 6 to 9, the lower end 27 of the vertical bar 24 is connected to the lower edge profile 28 of the cage mantle 22, wherein, as particularly shown in FIG. 8, due to a trough-shaped recess 60 formed in the lower edge profile, two edge ridges 61, 62 are formed in the lower edge profile 28, which run parallel in a longitudinal direction of the edge profile 28 and which form four points of contact 64 to 67 at a crossing site 63 with the edge ridges 45, 46 in the connection section 39 of the lower end 27 of the vertical bar 24, on which points of contacts the lower edge profile 28 and the lower end 27 of the vertical bar 24 are firmly connected via a contact welding.

FIG. 10 shows a vertical bar 71 which comprises a lower end 70 which deviates from the upper end 25. The upper end 25 of the vertical bar 71 is formed correspondingly to the upper end 25 of the vertical bar 24. The bar 71 can be used alternatively to bar 24 for forming the cage mantle 22 shown in FIG. 1.

As illustrated in FIGS. 11 to 14, the lower end 70 of the vertical bar 71, which is formed deviating from the upper end 25, can be connected in the same manner to the lower edge profile of the cage mantle 22 as the previously described lower end 27 of bar 24. As it is made particularly clear by comparing FIGS. 7 and 12, the bars 24 and 71 differ in the area of their lower ends 27 and 70, particularly in that the lower end 70 of bar 71 has a comparatively straightened and, compared to the lower end 27 of bar 24, elongated bent section 72.

Apart from that, the lower end 70 of bar 71 comprises a connection section 39, which is formed substantially identical to the lower end 27 of bar 24 and which particularly comprises edge ridges 73, 74 which extend from the connection section 39 to the bent section 72 and up into the longitudinal section 38 of bar 71. Further, between the edge ridges 73, 74 opposite to the convex wall section 56 formed by the convex cross-section outline 58 (FIG. 14), a recess 76 (FIG. 11) is formed. In contrast to the edge ridges 45 and 46 on the lower end 27 of bar 24, the edge ridges 73, 74 do not comprise humps 40 facing towards the outside 35, but have a substantially straight extension.

Due to the here above illustrated realization of the lower end 70 of bar 71 and in comparison to the upper end 25 of bar 71, said end 70 has a reduced stiffness, in particular due to the nonexistent humps 40 in the edge ridges 73, 74 and due to the comparatively large length of the bent section 72 as opposed to the bent section 41. However, the lower end 70, compared to the upper end 25, has a larger elasticity, in particular due to the comparatively slim realization of the bent section 72. The bar 71, illustrated in FIG. 10, thus is designed on its upper end 25 with a particularly high buckling stiffness in mind, whereas the lower end 70 of bar 71 is designed with a rather elastic form in mind.

Hereby, the finding is particularly addressed that it is substantial for a maximum of security against container failure, particularly when multiple containers are stacked on top of each other, that the bars are formed stiff against buckling on their upper ends, whereas the bars should provide good attenuation properties on their lower ends, particularly during dynamic use of the containers, for example during transport.

The invention claimed is:

1. A transport and storing container for liquids, said container comprising:

a base frame;

a plastic inner container supported by said base frame, said inner container having side walls, a lower wall, and an upper wall;

a closable filler neck formed on the upper wall;

a draining neck with a tapping armature formed on a lower section of at least one of said side walls; and a cage mantle with metal horizontal bars and metal vertical bars receiving the inner container, wherein lower ends of the vertical bars formed as a hollow profile are welded to a lower circumferential edge profile of the cage mantle and upper ends of the vertical bars formed as a hollow profile are welded to an upper circumferential edge profile of the cage mantle, at least the upper circumferential edge profile including a ridge running crosswise to the vertical bars forming connection sites for a welded joint with the upper ends of the vertical bars, and at least the upper ends of the vertical bars including a connection section with a cross section reduced by reshaping for the welded joint with the upper edge profile, the vertical bars including a bent section between the connection section and a linear longitudinal section with a tubular cross section, wherein at least the upper ends of the vertical bars include a convex cross-section outline, when viewed from inside the inner container, in a transition of the connection section to the bent section on an inner side of the transition facing the inner container.

2. The container according to claim 1, in which the upper ends of the vertical bars and the lower ends of the vertical bars include a convex cross section outline in the transition of the connection section to the bent section.

3. The container according to claim 1, in which the convex cross section outline extends from the connection section across the bent section into the longitudinal section and the bent section includes a recess at least in a transition area to the connection section.

4. The container according to claim 3, in which the recess is a groove and extends from the connection section to the longitudinal section.

5. The container according to claim 3, in which due to the recess in the cross section of the bent section edge ridges are formed, which extend into the connection section.

6. The container according to claim 3, in which due to the recess a kidney-shaped cross section is formed, which extends with a convex wall section of the bar opposite of the recess from the longitudinal section across the bent section into the connection section of the bar.

7. The container according to claim 6, in which the convex wall section together with the edge ridges of the recess in the connection section form a bowl-shaped connection trough with an edge ridge connecting the edge ridges.

8. The container according to claim 1, in which the upper ends of the vertical bars include a hump on an outer side of the transition facing away from the inner container, and formed on edge ridges in the transition of the connection section to the bent section.

9. The container according to claim 8, in which the edge ridges exhibit a substantially straight extension on the lower ends of the vertical bars in the transition from the connection section to the bent section.

10. The container according to claim 1, in which for the welded joint between the lower edge profile of the cage mantle and the lower ends of the vertical bars, the lower edge profile includes connection areas with a trough-shaped depression forming edge ridges that form crossing sites with edge ridges of the connection sections of the lower ends of the vertical bars.

* * * * *

UNITED STATES PATENT AND TRADEMARK OFFICE

CERTIFICATE OF CORRECTION

PATENT NO. : 9,004,310 B2
APPLICATION NO. : 13/687870
DATED : April 14, 2015
INVENTOR(S) : Udo Schütz It is certified that error appears in the above-identified patent and that said Letters Patent is hereby corrected as shown below:

In the Specification

Column 4, line 10
"section in" should be --section IIIb-IIIb in--

Signed and Sealed this
Thirteenth Day of October, 2015

Michelle K. Lee

Michelle K. Lee
*Director of the United States Patent and Trademark Office*